US010937400B1

(12) United States Patent
Chu et al.

(10) Patent No.: US 10,937,400 B1
(45) Date of Patent: Mar. 2, 2021

(54) CABLE-DRIVEN BEATER MECHANISM FOR PERCUSSION INSTRUMENT

(71) Applicant: RELIANCE INTERNATIONAL CORP., Taipei (TW)

(72) Inventors: Pei-Chi Chu, Taipei (TW); Cheng-Lin Ho, Taipei (TW); Wei-Ting Chen, Taipei (TW); Chi-Chia Huang, Taipei (TW)

(73) Assignee: RELIANCE INTERNATIONAL CORP., Taipei (TW)

( * ) Notice: Subject to any disclaimer, the term of this patent is extended or adjusted under 35 U.S.C. 154(b) by 0 days.

(21) Appl. No.: 16/836,911

(22) Filed: Mar. 31, 2020

(51) Int. Cl.
*G10D 13/02* (2020.01)
*G10D 13/11* (2020.01)

(52) U.S. Cl.
CPC ..... *G10D 13/11* (2020.02)

(58) Field of Classification Search
CPC ..... G10D 13/11
See application file for complete search history.

(56) References Cited

U.S. PATENT DOCUMENTS 609,570 A * 8/1898 Bowden ..... F16C 1/26 74/502.5
2,581,515 A * 1/1952 Christian ..... G10D 13/11 84/422.1
3,747,464 A * 7/1973 Russell ..... G10D 13/11 84/422.1
3,967,523 A * 7/1976 Currier ..... G10D 13/11 84/422.1
4,028,984 A * 6/1977 Sanchez ..... G10D 13/00 84/422.2
4,747,333 A * 5/1988 Hoshino ..... G10D 13/11 84/422.1
5,140,889 A * 8/1992 Segan ..... G10H 1/32 84/723
5,267,500 A * 12/1993 Lombardi ..... G10D 13/065 84/402
5,438,903 A * 8/1995 Cropek ..... G10D 13/11 84/422.3
5,789,688 A * 8/1998 Schiano ..... G10D 13/11 84/422.1
6,049,032 A * 4/2000 Liao ..... G10D 13/065 84/422.1

(Continued)

*Primary Examiner* — Robert W Horn
(74) *Attorney, Agent, or Firm* — Hershkovitz & Associates, PLLC; Abe Hershkovitz

(57) ABSTRACT

A cable-driven beater mechanism for a percussion instrument has a base, a transmission shaft pivotally mounted on the base, a beater connected to the transmission shaft, a cable transmission assembly, a restoring spring and a cable. An elongated guiding slot is formed in the standing plate. The cable transmission assembly is pivotally mounted on the base and protrudes into the guiding slot. The cable and the transmission shaft are connected via the cable transmission assembly. Pulling force from a player is transferred via the cable to pivot the transmission shaft and the beater. The restoring spring returns the transmission shaft and the beater to an original position. The cable moves along a straight line during operation to reduce rubbing and repeated bending of the cable, which prolongs service life of the cable, reduces noise during operation, and allows the beater to respond more swiftly to the pulling force.

8 Claims, 9 Drawing Sheets

(56) References Cited

U.S. PATENT DOCUMENTS

| | | | | |
|---|---|---|---|---|
| 6,075,191 | A * | 6/2000 | Scire | G10D 13/11 84/422.1 |
| 6,545,204 | B1 * | 4/2003 | Wadell | G10H 1/348 84/422.1 |
| 6,977,333 | B2 * | 12/2005 | Sutej | G10D 13/065 84/422.1 |
| 7,126,050 | B1 * | 10/2006 | Lombardi | G10D 13/065 84/422.1 |
| 8,624,097 | B1 * | 1/2014 | Liao | G10D 13/11 84/422.1 |
| 9,875,730 | B2 * | 1/2018 | Cannon | G10D 13/11 |
| 10,600,394 | B2 * | 3/2020 | Lin | G10D 13/11 |
| 2006/0150801 | A1 * | 7/2006 | Veiga | G10D 13/11 84/422.1 |
| 2007/0234876 | A1 * | 10/2007 | Veiga | G10D 13/11 84/422.1 |
| 2012/0180617 | A1 * | 7/2012 | Dorfman | G10D 13/065 84/422.3 |
| 2014/0182445 | A1 * | 7/2014 | Liao | G10D 13/11 84/422.1 |
| 2015/0059555 | A1 * | 3/2015 | Liao | G10D 13/12 84/422.1 |
| 2016/0196810 | A1 * | 7/2016 | Sikra | G10D 13/11 84/422.1 |

* cited by examiner

CABLE-DRIVEN BEATER MECHANISM FOR PERCUSSION INSTRUMENT

BACKGROUND OF THE INVENTION

1. Field of the Invention

The present invention relates to a beater mechanism for a percussion instrument, especially to a cable-driven beater mechanism for beating a Cajon.

2. Description of the Prior Arts

A percussion instrument is often played by slapping with the hands or by hitting with a hand-held beater. A percussion instrument can also be played by a beater which is driven by a foot-operated beating device. Said foot-operated beating device comprises mainly a pedal mechanism and a beater mechanism. A foot board of the pedal mechanism is connected to a beater of the beater mechanism through a linkage set or a cable. To play the percussion instrument, a player pressed down the foot board to swing the beater and to make the beater hit the percussion instrument.

With reference to FIG. 8, a conventional beater mechanism for a percussion instrument comprises a base 81, a transmission shaft 82, a beater 83, a rocker arm 84, and a cable 85. A locating stud 811 protrudes from a lateral surface of the base 81. The transmission shaft 82 is transversely mounted through a top of the base 81. The beater 83 and the rocker arm 84 are fixed to the transmission shaft 82. The rocker arm 84 and the locating stud 811 are located on the same side of the transmission shaft 82. A tension spring (not shown in figures) is mounted on a side of the base 81, and two ends of the tension spring are mounted on the base 81 and the transmission shaft 82 respectively. After the transmission shaft 82 has been pivoted, the tension spring is capable of returning the transmission shaft 82 to its original position. The cable 85 is wrapped around by the cable housing 86. One end of the cable housing 86 is fixed to the locating stud 811. The other end of the cable housing 86 extends toward the pedal mechanism and is connected to the pedal mechanism. A connecting end of the cable 85 protrudes from the cable housing 86 and is inserted through the locating stud 811 to extend toward the rocker arm 84. The connecting end of the cable 85 is winded around a fixing part 87, which is mounted on the rocker arm 84, and the connecting end of the cable 85 is clamped between the rocker arm 84 the fixing part 87.

With further reference to FIG. 8 and FIG. 9, when the player presses down the foot board of the pedal mechanism, the cable 85 pulls the rocker arm 84 and makes the transmission shaft 82 pivot, which in turn swings the beater 83 towards the percussion instrument and then hits the percussion instrument. When the player releases the foot board, the tension spring makes the transmission shaft 82 pivot in reverse, which in turn swings the beater 83 away from the percussion instrument and returns the beater 83 to its original position.

However, the cable 85 is connected directly to the rocker arm 84, therefore when the beater 83 is swung by the rocker arm 84, the cable 85 swings together with the rocker arm 84, causing the inclination angle of the cable 85 to change repeatedly, which in turn makes the locating stud 811 repeatedly rub against the fixing part 87, and also bends the connecting end of the cable 85 repeatedly. As a result, the cable 85 snaps prematurely and has to be replaced. Moreover, the rubbing between the locating stud 811 and the fixing part 87 not only generates noise that affects the sound quality of the percussion instrument, but also affects correct operation of the rocker arm 84 and the beater 83, which affects the performance of the percussion instrument when performing fast-tempo beats.

To overcome the shortcomings, the present invention provides a cable-driven beater mechanism for a percussion instrument to mitigate or obviate the aforementioned problems.

SUMMARY OF THE INVENTION

The main objective of the present invention is to provide a cable-driven beater mechanism for a percussion instrument that prevents rubbing and repeated bending of the cable during operation of the beater mechanism to reduce noise and to prevent the cable from snapping.

The cable-driven beater mechanism for a percussion instrument has a base, a transmission shaft, a beater, a cable transmission assembly, a restoring spring and a cable. The base has a standing plate disposed vertically. An elongated guiding slot is formed in the standing plate. The transmission shaft is transversely and pivotally mounted through the standing plate of the base. An end of the beater is fixed to the transmission shaft. The cable transmission assembly is mounted on the transmission shaft, and comprises a first rocker arm, a curved link arm, and a sliding assembly. An end of the first rocker arm is fixed to the transmission shaft. A first end of the link arm is pivotally connected to the first rocker arm. A second end of the link arm has a sleeve portion and a through hole. The sleeve portion corresponds in position to the elongated guiding slot of the base. The through hole is formed through a side wall of the sleeve portion. An end of the sliding assembly is mounted through and assembled in the sleeve portion of the link arm. Another end of the sliding assembly protrudes into the elongated guiding slot. The restoring spring connects the base and the transmission shaft. An end of the cable is inserted through the through hole of the sleeve portion of the link arm and is connected to the sliding assembly.

The advantage of the cable-driven beater mechanism for a percussion instrument is that when swinging the beater back and forth, the cable moves along the elongated guiding slot, and moves along a straight line relative to the cable housing and the locating stud to reduce repeated bending and rubbing of the cable. As a result, service life of the cable is prolonged, and snapping of the cable may be completely avoided. Moreover, noise is reduced due to less rubbing, which improves the sound quality of the percussion instrument. In addition, less rubbing also ensures smoother movement of the link arm, which in turn allows the beater to respond more swiftly when the player presses down or releases the foot board, which improves the performance of the beater mechanism when performing fast-tempo beats.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
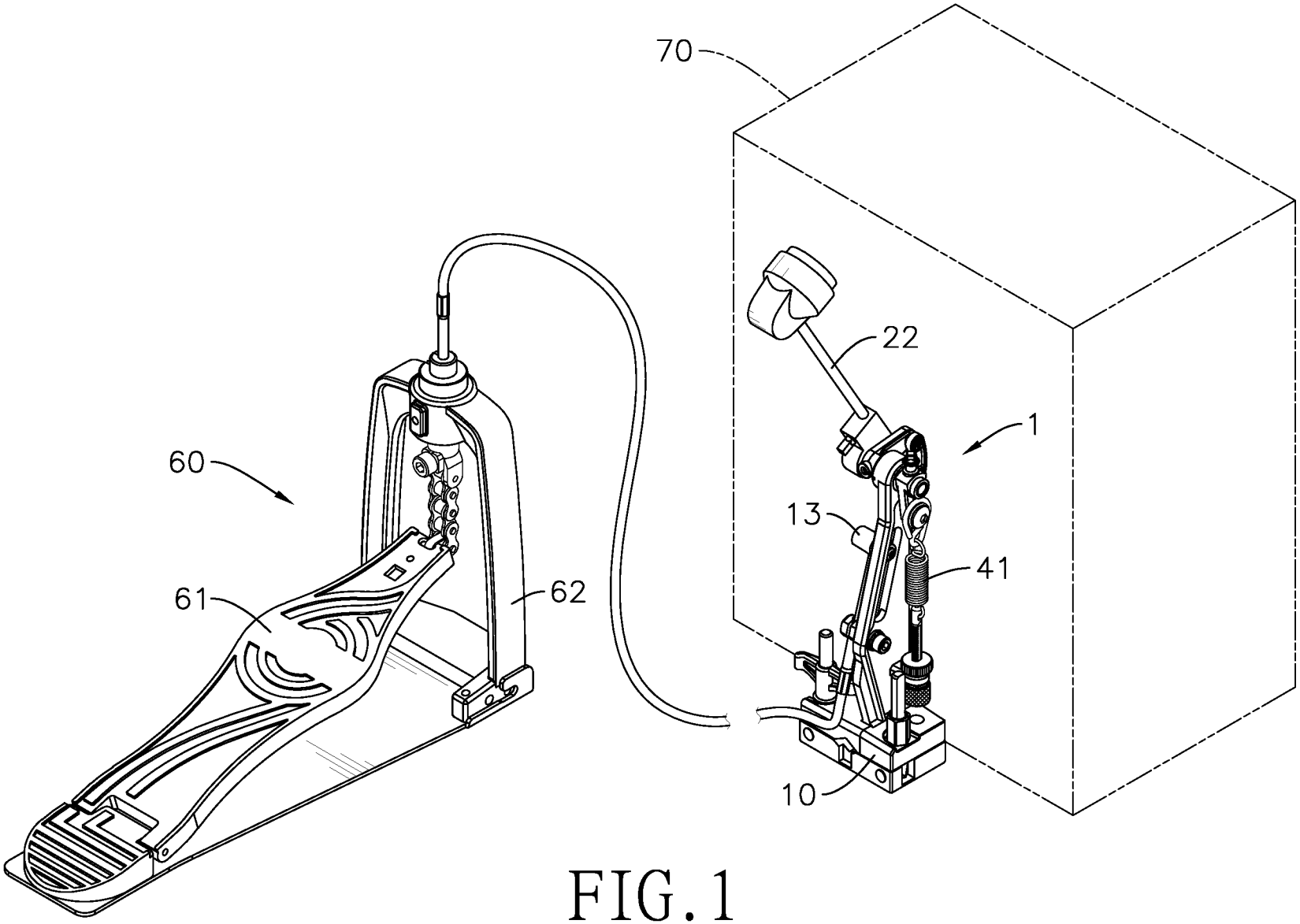
FIG. 1 is a perspective view of a cable-driven beater mechanism for a percussion instrument in accordance with the present invention, shown in an operating status.
Figure 2:
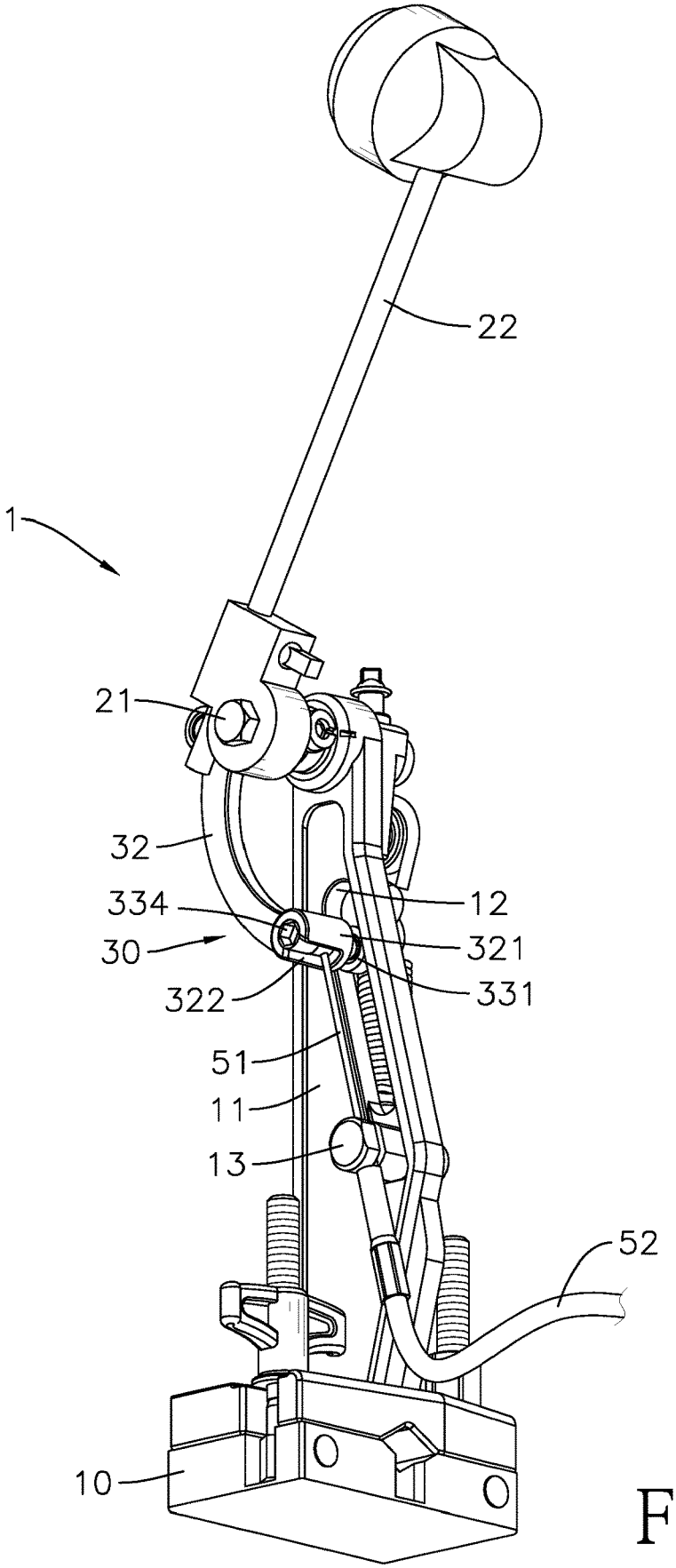
FIG. 2 is a perspective view of the beater mechanism in FIG. 1.
Figure 3:
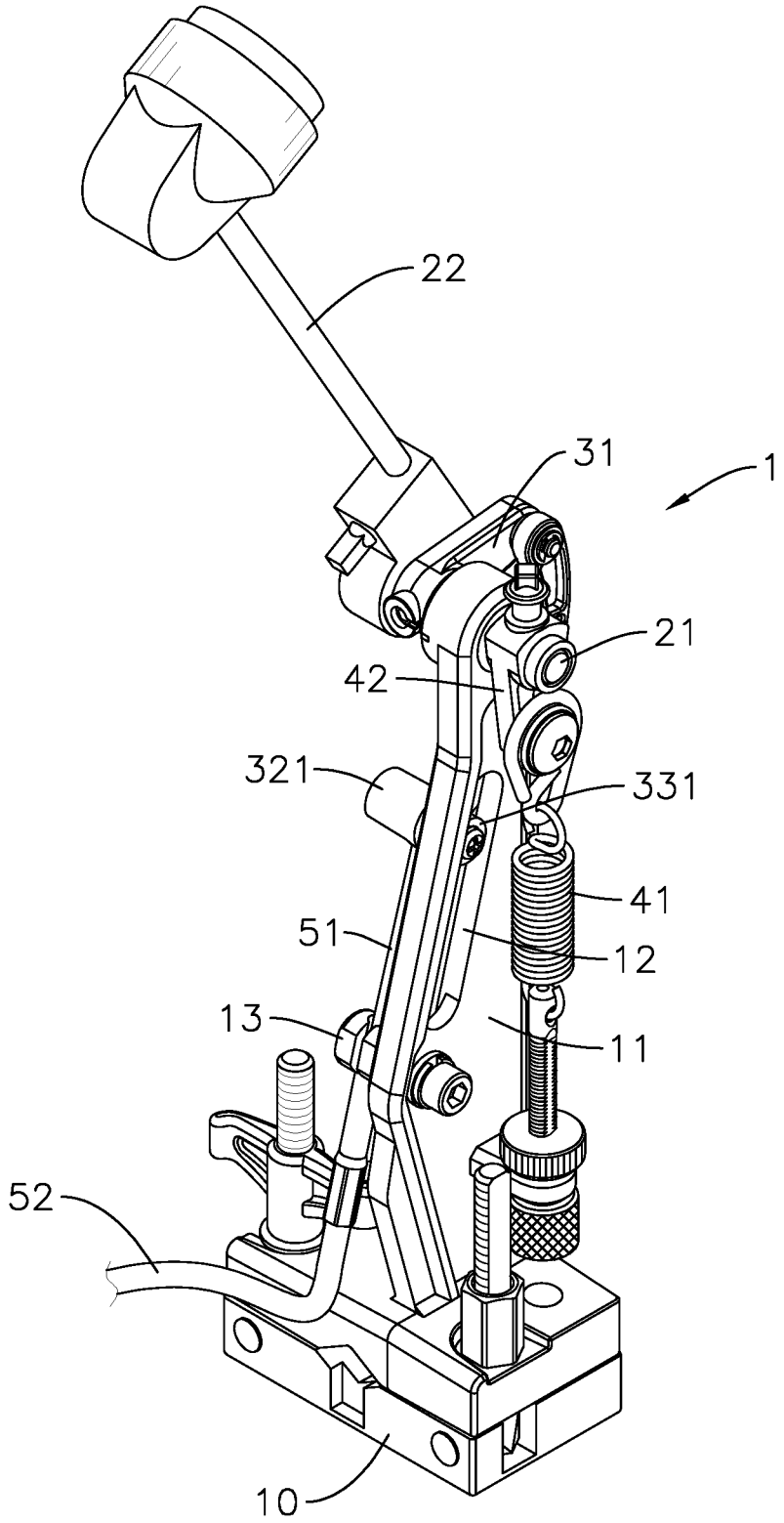
FIG. 3 is another perspective view of the beater mechanism in FIG. 1.
Figure 4:
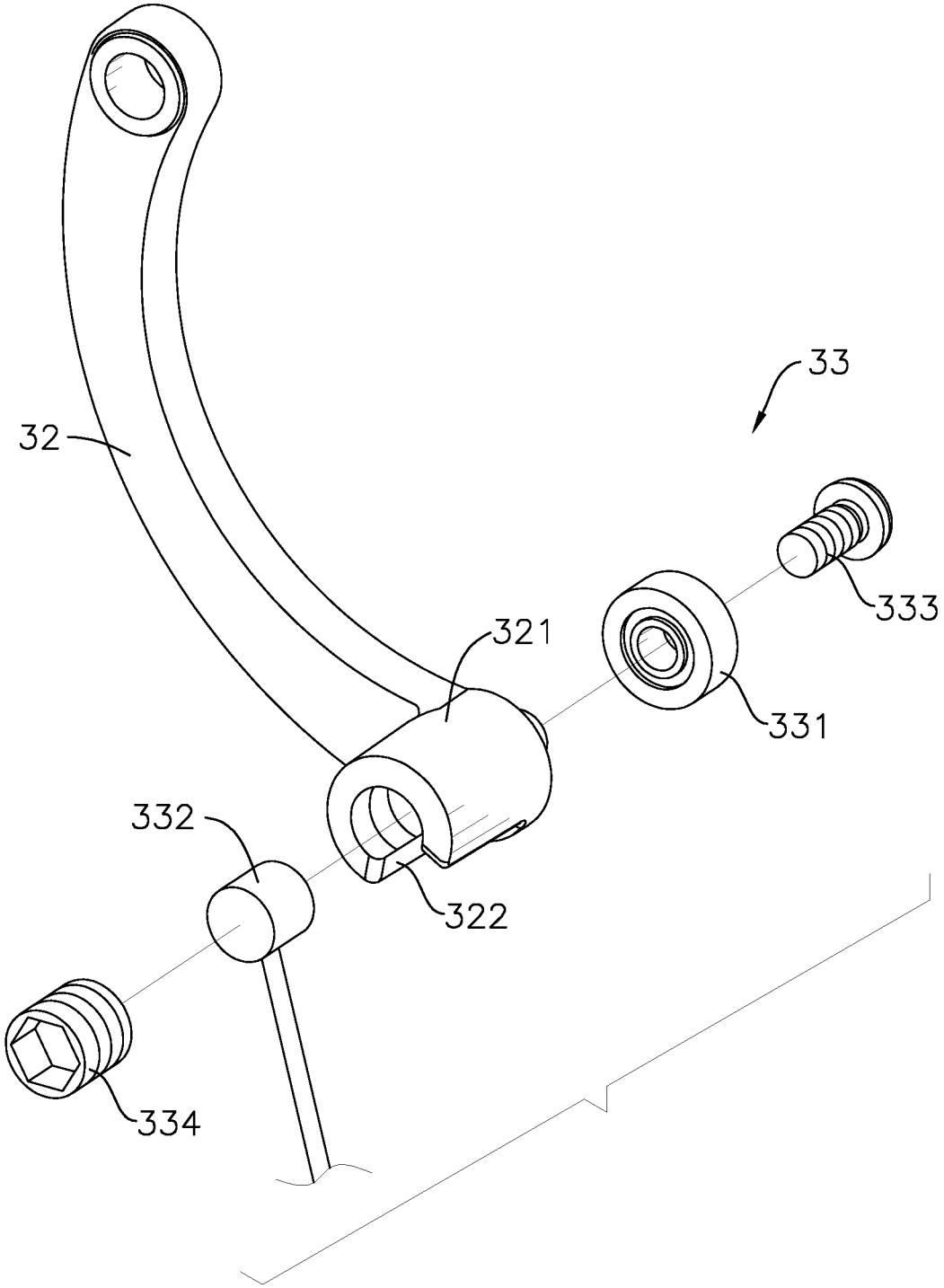
FIG. 4 is an exploded view of a link arm and a sliding assembly of the beater mechanism in FIG. 1.

With reference to FIG. 1, a beating device for beating a Cajon 70 is shown schematically. The beating device comprises a beater mechanism 1 in accordance with the present invention, and a pedal mechanism 60. The pedal mechanism 60 has a foot board 61. With further reference to FIGS. 2 and 3, the beater mechanism 1 has a base 10, a transmission shaft 21, a beater 22, a cable transmission assembly 30, a restoring spring 41 and a cable 51.

Figure 7:
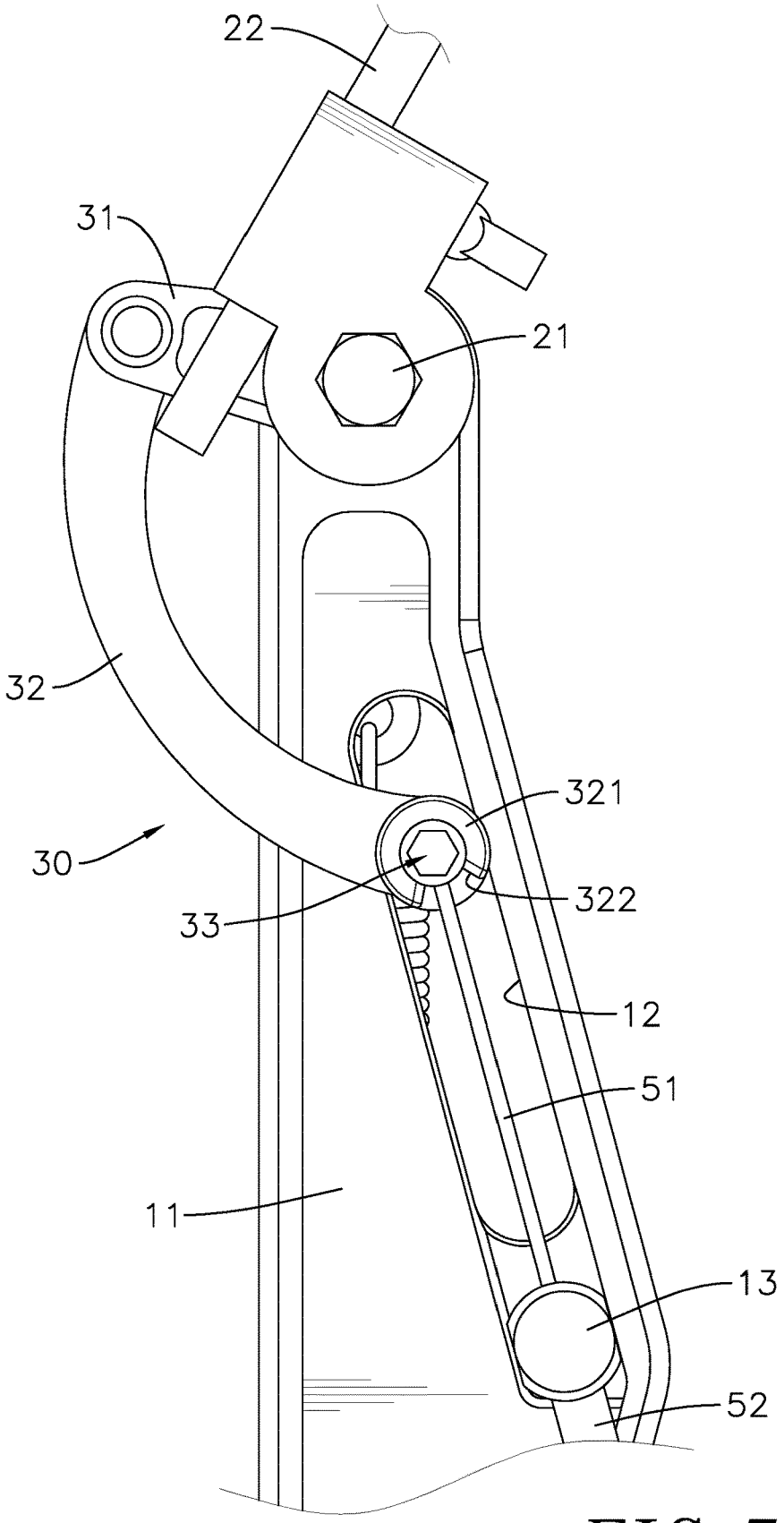
FIG. 7 is an enlarged side view of the beater mechanism in FIG. 1.
Figure 8:
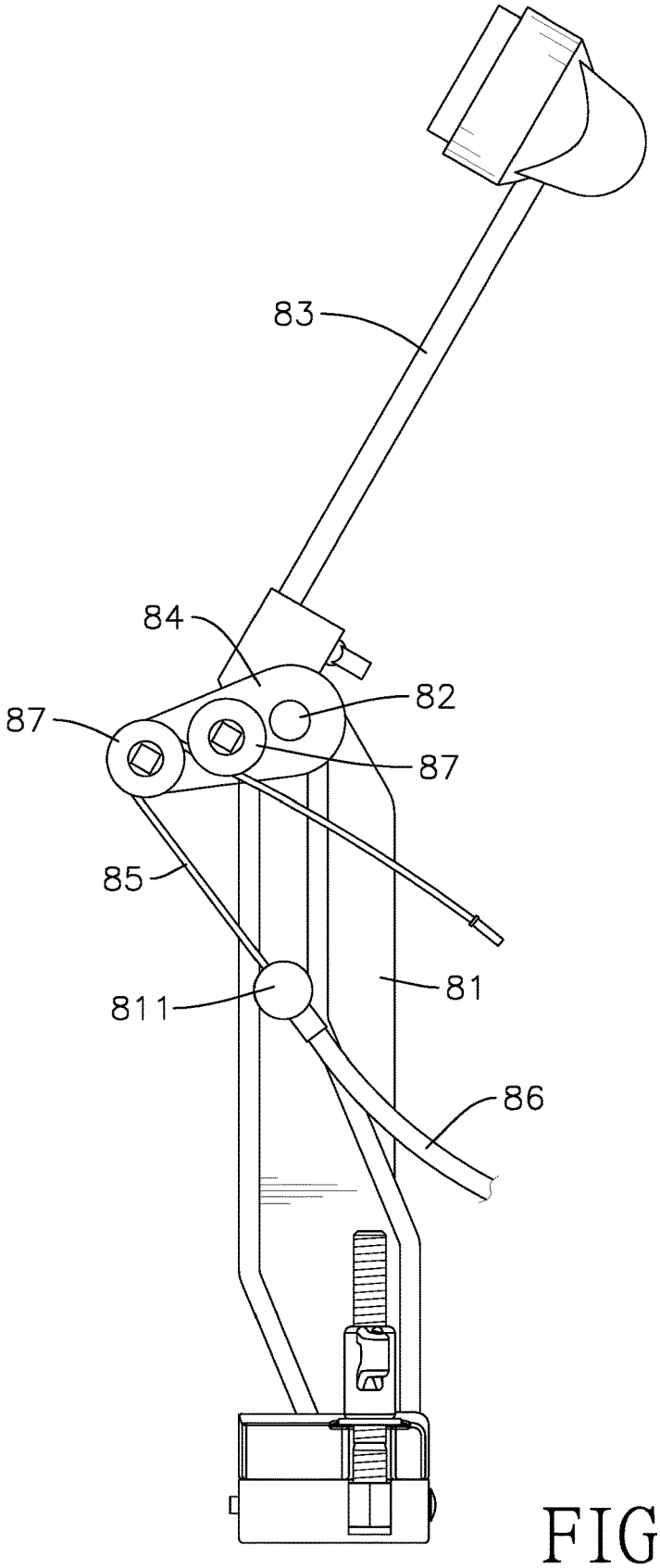
FIG. 8 PRIOR ART
FIGS. 8 and 9 are side views of a conventional beater mechanism, shown in different statuses.
Figure 9:
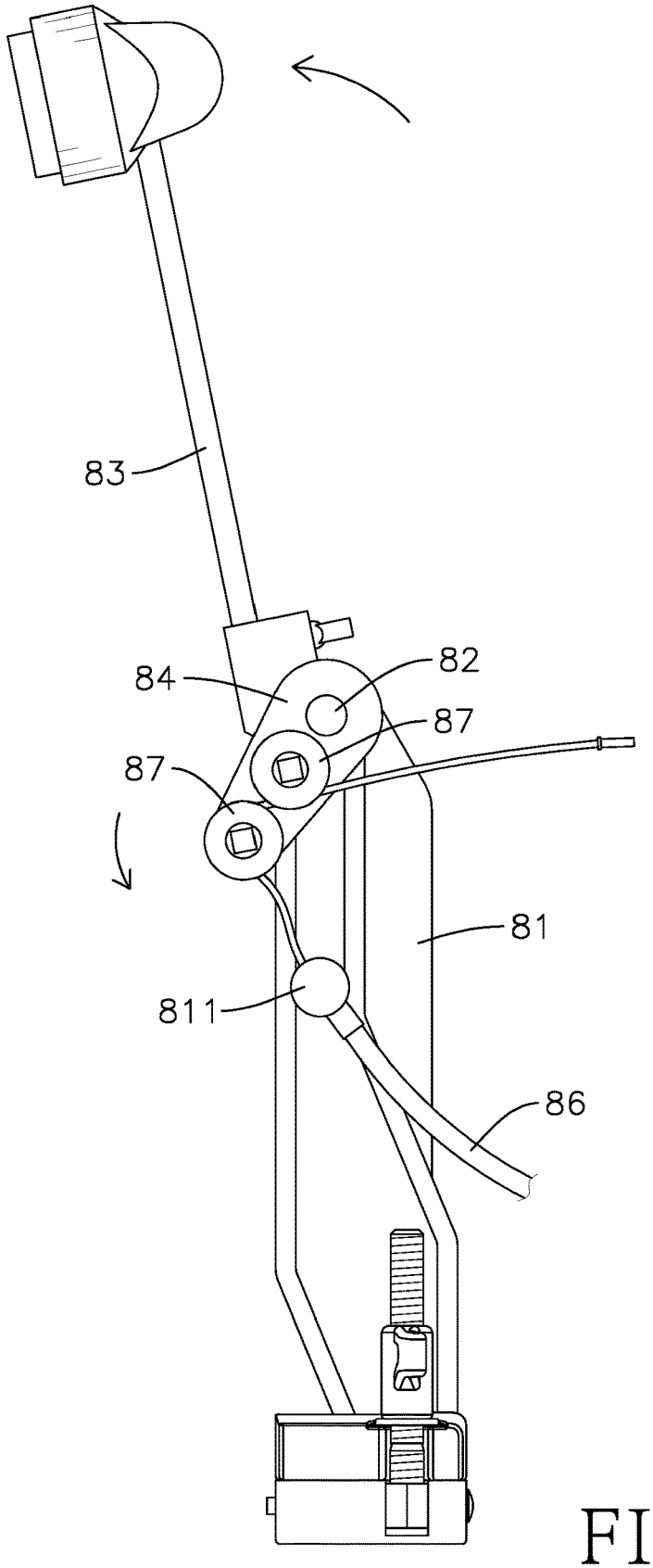
FIG.9 PRIOR ART

With reference to FIGS. 2 and 7, the base has a standing plate 11 disposed vertically. The standing plate 11 has an elongated guiding slot 12 and a locating stud 13 protruding transversely. The elongated guiding slot 12 extends obliquely along an imaginary straight line. The locating stud 13 is located along a direction in which the elongated guiding slot 12 extends. In a preferred embodiment, the locating stud 13 is located adjacent to an end of the elongated guiding slot 12.

The transmission shaft 21 is transversely and pivotally mounted through the standing plate 11 of the base 10. An end of the beater 22 is fixed to the transmission shaft 21. Pivoting the transmission shaft 21 back and forth makes the beater 22 swing back and forth.

With reference to FIG. 3, the cable transmission assembly 30 is mounted on the transmission shaft 21, and comprises a first rocker arm 31, a link arm 32 and a sliding assembly 33. An end of the first rocker arm 31 is fixed to the transmission shaft 21. The link arm 32 is curved and has a first end, a second end and a sleeve portion 321. The first end and the second end are opposite ends of the link arm 32. The first end of the link arm 32 is pivotally connected to the first rocker arm 31.

The sleeve portion 321 is formed on the second end of the link arm 32, and the sleeve portion 321 corresponds in position to the elongated guiding slot 12 of the base 10. A through hole 322 is formed through a side wall of the sleeve portion 321, and an opening of the through hole 322 is toward the locating stud 13. An end of the sliding assembly 33 is mounted through and assembled in the sleeve portion 321 of the link arm 32, and another end of the sliding assembly 33 protrudes into the elongated guiding slot 12 of the base 10 to make the sliding assembly 33 move along the elongated guiding slot 12.

With reference to FIG. 3, the restoring spring 41 connects the base 10 and the transmission shaft 21. The restoring spring 41 is forcefully deformed when the transmission shaft 21 is pivoted away from an original position, and the restoring spring 41 is capable of returning the transmission shaft 21 to the original position.

In a preferred embodiment, a second rocker arm 42 is connected between the restoring spring 41 and the transmission shaft 21. An end of the second rocker arm 42 is fixed to the transmission shaft 21, and another end of the second rocker arm 42 is pivotally connected to an end of the restoring spring 41. To be precise, the restoring spring 41 is a tension spring.

In a preferred embodiment, the cable transmission assembly 30 and the restoring spring 41 are mounted on opposite sides of the standing plate 11 respectively. However, the cable transmission assembly 30 and the restoring spring 41 can also be mounted on the same side of the standing plate 11 as long as no interference is incurred between said two components.

An end of the cable 51 is a connecting end, and said connecting end is inserted through the through hole 322 of the sleeve portion 321 of the link arm 32, and is connected to the sliding assembly 33. The other end of the cable 51 is connected to the foot board 61 of the pedal mechanism 60.

To achieve a better performance, the cable 51 is wrapped around by a cable housing 52. An end of the cable housing 52 is connected to the locating stud 13, and the other end of the cable housing 52 is fixed to a bracket 62 of the pedal mechanism 60. The cable is mounted in the cable housing 52. The connecting end of the cable 51 protrudes from the cable housing 52, is mounted through the locating stud 13 and the through hole 322 of the sleeve portion 321 of the link arm 32, and is connected to the sliding assembly 33. The other end of the cable 51 protrudes from the cable housing 52 to connect the foot board 61 of the pedal mechanism 60.

In a preferred embodiment, said sliding assembly 33 comprises a rolling bearing 331 and a connecting block 332. The rolling bearing 331 is mounted on an end of the sleeve portion 321 of the link arm 32. A first fixing part 333 is mounted through the rolling bearing 331 and is assembled to the sleeve portion 321 to fix a position of the rolling bearing 331. The rolling bearing 331 is mounted inside the elongated guiding slot 12 of the base 10, and is capable of moving along the elongated guiding slot 12 smoothly.

The connecting block 332 is mounted in the sleeve portion 321 of the link arm 32. The second fixing part 333 is located on a side of the connecting block 332, and a second fixing part 334 is located on the other side of the connecting block 332. The second fixing part 334 is assembled in the sleeve portion 321. The first fixing part 333 and the second fixing part 334 keep the connecting block 332 inside the sleeve portion 321. A cable 51 is inserted through the through hole 322 of the sleeve portion 321 of the link arm 32 and is connected to the connecting block 332 of the sliding assembly 33.

Figure 5:
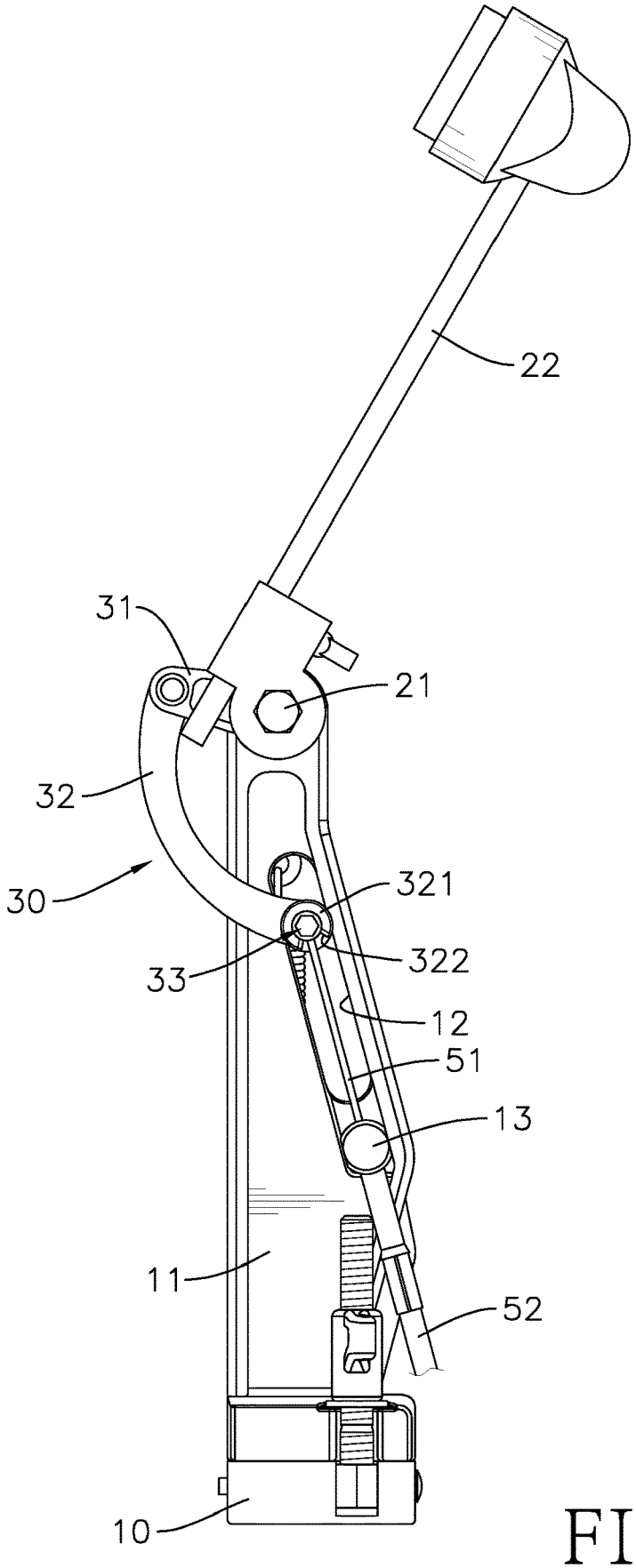
FIGS. 5 and 6 are side views of the beater mechanism in FIG. 1, shown in different statuses.
Figure 6:
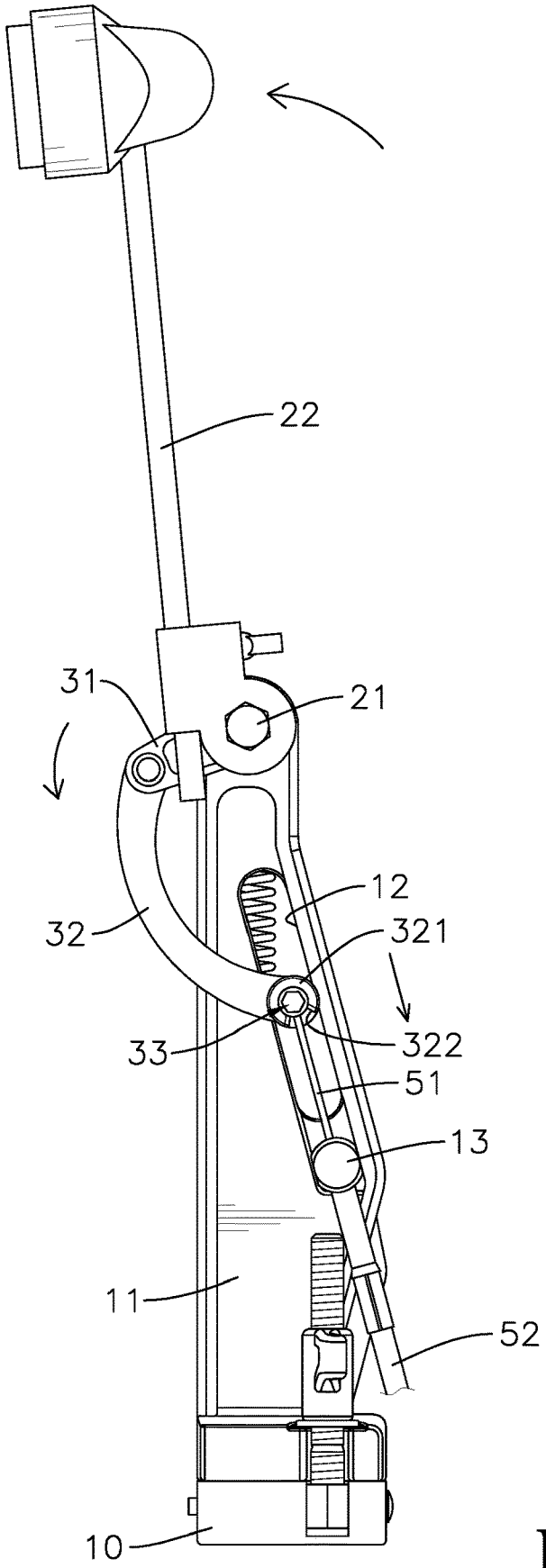

With further reference to FIGS. 5 and 6, when the foot board 61 is pressed down by a player, the sliding assembly 33 is pulled by the foot board 61 via the cable 51, and in turn the sleeve portion 321 of the link-arm 32 is pulled and moved along the elongated guiding slot 12. The movement of the sleeve portion 321 makes the transmission shaft 21 and the beater 22 swing forward to hit on the Cajon 70.

When the player releases the foot board 61, the restoring spring 41 makes the transmission shaft 21 pivot in reverse via the second rocker arm 42 to return the beater 22 to the original position. The sliding assembly 33 and the sleeve portion 321 of the link arm 32 also move along the elongated guiding slot 12 in reverse.

By designing the beater mechanism 1 as described above, when swinging the beater 22 back and forth, the cable 51 moves along the elongated guiding slot 12, and moves along a straight line relative to the cable housing 52 and the locating stud 13 to reduce repeated bending and rubbing of the cable 51. As a result, service life of the cable 51 is prolonged. Moreover, noise is reduced due to less rubbing, which improves the sound quality of the Cajon 70. In addition, less rubbing also ensures smoother movement of the link arm 32, which in turn allows the beater 22 to respond more swiftly when the player presses down or releases the foot board 61, which improves the performance of the beater mechanism 1 when performing fast-tempo beats.

In addition to the Cajon 70, the beater mechanism 1 of the present invention can also be adapted to other types of percussion instruments. For example, the beater mechanism 1 can be adapted to striking a cymbal by fixing the base 10 to a stand of the cymbal.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cable-driven beater mechanism for a percussion instrument, the cable-driven beater mechanism comprising:
- a base having
  - a standing plate disposed vertically and having
    - an elongated guiding slot formed in the standing plate;
- a transmission shaft transversely and pivotally mounted through the standing plate of the base;
- a beater; an end of the beater fixed to the transmission shaft;
- a cable transmission assembly mounted on the transmission shaft, and comprising
  - a first rocker arm; an end of the first rocker arm fixed to the transmission shaft;
  - a curved link arm; a first end of the link arm pivotally connected to the first rocker arm; a second end of the link arm having:
    - a sleeve portion corresponding in position to the elongated guiding slot of the base; and
    - a through hole formed through a side wall of the sleeve portion; and
  - a sliding assembly; an end of the sliding assembly mounted through and assembled in the sleeve portion of the link arm; another end of the sliding assembly protruding into the elongated guiding slot;
- a restoring spring connecting the base and the transmission shaft; and
- a cable; an end of the cable inserted through the through hole of the sleeve portion of the link arm and connected to the sliding assembly.

2. The cable-driven beater mechanism as claimed in claim 1, wherein:
- the base further has:
  - a locating stud; the locating stud protruding transversely from the base, and located along a direction in which the elongated guiding slot extends;
  - an opening of the through hole of the sleeve portion of the link arm is toward the locating stud;
- the cable is wrapped around by a cable housing; an end of the cable housing is connected to the locating stud; the cable is mounted in the cable housing; the end of the cable protrudes from the cable housing, is inserted through the locating stud and the through hole of the sleeve portion of the link arm, and is connected to the sliding assembly.

3. The cable-driven beater mechanism as claimed in claim 1, wherein a second rocker arm is connected between the restoring spring and the transmission shaft; an end of the second rocker arm is fixed to the transmission shaft; another end of the second rocker arm is pivotally connected to an end of the restoring spring.

4. The cable-driven beater mechanism as claimed in claim 2, wherein a second rocker arm is connected between the restoring spring and the transmission shaft; an end of the second rocker arm is fixed to the transmission shaft; another end of the second rocker arm is pivotally connected to an end of the restoring spring.

5. The cable-driven beater mechanism as claimed in claim 1, wherein the restoring spring is a tension spring.

6. The cable-driven beater mechanism as claimed in claim 4, wherein the restoring spring is a tension spring.

7. The cable-driven beater mechanism as claimed in claim 1, wherein
- the sliding assembly comprises:
  - a rolling bearing mounted on an end of the sleeve portion of the link arm, and located inside the elongated guiding slot of the base;
  - a first fixing part mounted through the rolling bearing and assembled to the sleeve portion;
  - a second fixing part assembled in the sleeve portion; and
  - a connecting block mounted in the sleeve portion, and located between the first fixing part and the second fixing part;
- the cable is inserted through the through hole of the sleeve portion of the link arm and is connected to the connecting block of the sliding assembly.

8. The cable-driven beater mechanism as claimed in claim 6, wherein
- the sliding assembly comprises:
  - a rolling bearing mounted on an end of the sleeve portion of the link arm, and located inside the elongated guiding slot of the base;
  - a first fixing part mounted through the rolling bearing and assembled to the sleeve portion;
  - a second fixing part assembled in the sleeve portion; and
  - a connecting block mounted in the sleeve portion, and located between the first fixing part and the second fixing part;
- the cable is inserted through the through hole of the sleeve portion of the link arm and is connected to the connecting block of the sliding assembly.

* * * * *